United States Patent [19]

Bruce

[11] Patent Number: 4,479,742

[45] Date of Patent: Oct. 30, 1984

[54] MOBILE BOTTOM-FOUNDED CAISSON FOR ARCTIC OPERATIONS

[75] Inventor: John C. Bruce, North Vancouver, Canada

[73] Assignee: Gulf Canada Limited, Toronto, Canada

[21] Appl. No.: 345,439

[22] Filed: Feb. 3, 1982

[51] Int. Cl.[3] ..... E02D 21/00; E02D 23/02; E02D 31/00

[52] U.S. Cl. ..... 405/217; 405/205; 405/211

[58] Field of Search ..... 405/131, 203, 205, 207, 405/211, 217, 229

[56] References Cited

U.S. PATENT DOCUMENTS

| | | | |
|---|---|---|---|
| 2,235,695 | 3/1941 | Ackley | 405/131 |
| 2,332,227 | 10/1943 | Jackson | 405/131 |
| 2,472,869 | 6/1949 | Travers | 175/8 |
| 3,668,368 | 6/1972 | Moldskred | 405/131 X |
| 3,972,199 | 8/1976 | Hudson et al. | 405/217 |
| 4,187,039 | 2/1980 | Jahns et al. | 405/217 |
| 4,245,929 | 1/1981 | Pearce et al. | 405/211 |
| 4,260,292 | 4/1981 | Steddum et al. | 405/217 |
| 4,265,569 | 5/1981 | Gefvert | 405/217 |

FOREIGN PATENT DOCUMENTS 1082933 8/1980 Canada .

OTHER PUBLICATIONS

"Cone Seen Defense Against Ice in Arctic", Oil and Gas Journal, Apr. 27, 1970.

*Primary Examiner*—Cornelius J. Husar
*Assistant Examiner*—Nancy J. Stodola
*Attorney, Agent, or Firm*—R. H. Saunders

[57] ABSTRACT

A floatable bottom-founded caisson is disclosed that is suitable for use in ice-covered waters. The annular caisson structure has a frusto-conical upwardly tapered inner wall which reduces skin friction between itself and the core fill material. By the application of heat and the use of insulation, freezing of the core fill material is prevented; this feature, together with the tapered wall, enables the caisson to be easily raised and moved to a new position. The outer, or perimetrical, wall is inclined to aid upward fracturing of the ice impinging on it. The caisson carries a deck structure for the support of offshore drilling or other equipment.

19 Claims, 3 Drawing Figures

MOBILE BOTTOM-FOUNDED CAISSON FOR ARCTIC OPERATIONS

This invention relates to a caisson for the support of equipment for carrying out offshore exploration and production in shallow waters, and more particularly to a mobile bottom-founded caisson suitable for use in Arctic waters that are covered by sheet ice for a large portion of the year.

In drilling wells in Arctic waters it is common to use man-made islands in shallow waters; such islands are made by creating a sloped beam, for example by dredging or by depositing fill material on the sea bed, until the material rises far enough above the sea surface to be resistant to wave, wind and ice action. Because the maximum angle of repose of material deposited near the surface in this way is small, the use of such islands is limited to shallow waters by the cost of moving huge amounts of fill. Consequently, caisson-retained islands have been proposed to provide greater slopes than are possible with man-made islands, by employing materials of construction, for example steel or concrete, that can be set at steeper angles to reduce the amount of fill material needed. Sectional artificial islands have been proposed for use in Arctic conditions, for example by Bruce et al in Canadian Pat. No. 1,082,933, comprising solid wall sections which are fastened together on-site, the resulting box-shaped structure being ballasted with water and the core filled with sand. These have the disadvantage that the equipment to be used on the island must be removed and the island disassembled in order to move it to a new location. Unitary artificial islands have been proposed for non-icing conditions, for example the annular island described by Travers in U.S. Pat. No. 2,472,869, constructed of concrete and capable of being floated from one location to another, and set down, by deballasting and ballasting as required. A unitary removable platform for Arctic conditions was disclosed by Hudson et al in U.S. Pat. No. 3,972,199. In order to minimize the horizontal forces generated by the ice cover, that platform utilized a frusto-conical exterior shape that pushed the ice cover upward to cause lateral fracturing of the ice into smaller pieces which were pushed around and away from the platform by the movement of the ice cover. Heated surfaces and low-friction ice-contacting materials were employed to reduce adhesion of ice to the platform. It was disclosed in addition that even with these measures, piles might be needed to secure the platform against horizontal ice forces. The system's principal disadvantages were the need for heated surfaces which dissipated considerable amounts of heat into the ice, and the need for costly low-friction materials to provide a low-adhesion surface. Many low-friction materials, moreover, have poor adhesion to the substrate as well as to the ice.

It has now been found that these disadvantages can be overcome by the present invention, which consists in a floatable caisson capable of being maintained in a fixed position in an ice-covered body of water, comprising:

(a) a perimetrical wall having an upper portion of sufficient height and disposed at a sufficient angle to the normal surface of said body of water to aid upward fracturing of said ice cover, (b) an inner wall and a bottom defining with said perimetrical wall an annular structure, a lower portion of said inner wall sloping outwardly and downwardly towards said bottom, said annular structure being capable of supporting a deck structure extending across its central opening, and (c) means to maintain in an unfrozen state any liquid ballast placed in said annular structure and any fill material placed in the volume defined by said inner wall.

The invention further consists in a method for constructing an artificial island for offshore operations in an ice-covered body of water, comprising:

(a) setting upon the bottom of said body of water a floatable caisson having a perimetrical wall whose upper portion is of sufficient height and disposed at a sufficient angle to the normal surface of said body of water to aid upward fracturing of said ice cover, said caisson also having an inner wall and a bottom defining with said perimetrical wall an annular structure, a lower portion of said inner wall extending outwardly and downwardly towards said bottom, said caisson being capable of supporting a deck structure extending across its central opening, (b) placing liquid ballast material in said annular structure, (c) placing core fill material in said central opening, and (d) maintaining said ballast and core fill material in an unfrozen state.

In drawings which illustrate a preferred embodiment of the invention,

Figure 1:
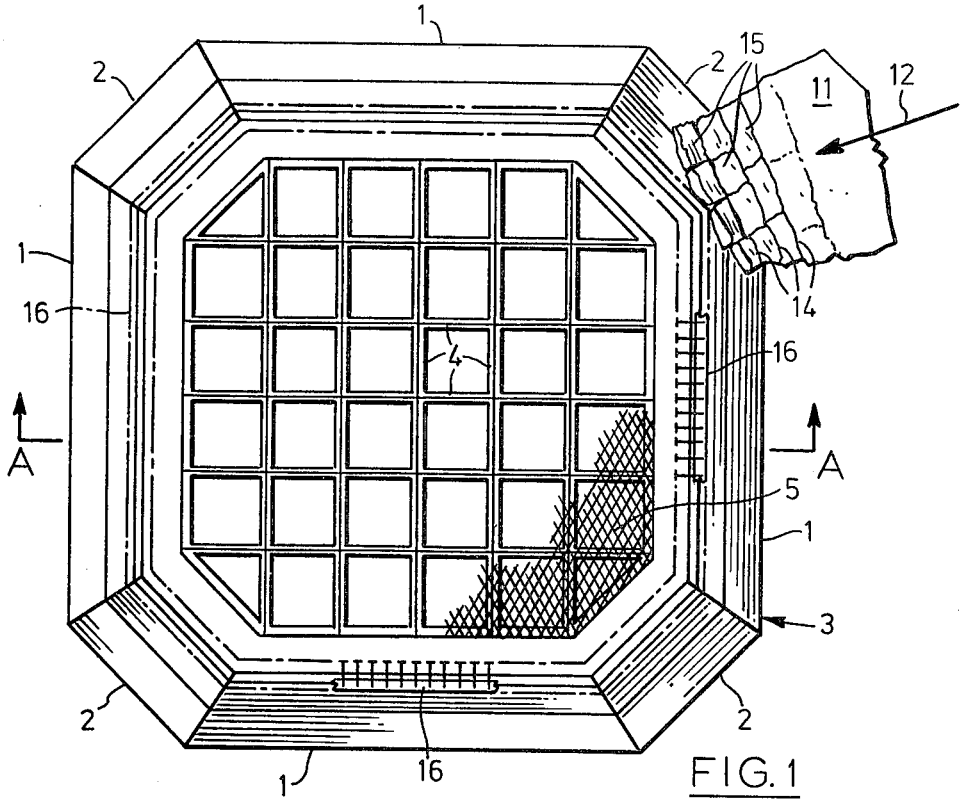
FIG. 1 shows in plan view a caisson constructed according to a preferred embodiment of the invention.

The caisson of the invention, being a unitary platform, can be towed, when operations are completed at an offshore site, and set into place in a new site in a relatively short time. It can be set into place by ballasting to a state of negative buoyancy until the base of the caisson rests on the bottom of a prepared site. Site preparation consists in ensuring that a reasonably level, compacted base is capable of withstanding the requisite vertical and horizontal forces and is at a depth below the water surface such that the bottom of the deck structure rests at about the normal water level. Material can be removed and/or added to the sea bed to achieve this condition, and densified or compacted if necessary.

The inner wall has at least a lower portion of a frusto-conical shape, the extended point being upwards, which overcomes skin friction during the raising operation and avoids the sudden uncontrolled upward motion that would otherwise occur. The upper portion of the inner wall is substantially cylindrical. The core fill is maintained in the unfrozen state, in which condition a portion of it is easily removable to gain clearance for towing away the floating caisson after the offshore operation is completed.

The inner wall of the annulus is in contact with core fill when in the settled, or operating, mode, and at least a substantially one-third portion of it is at an angle to the vertical from substantially 2° to substantially 10° so that the opening is larger at the bottom of the annular structure than at its top. The novel taper enables the caisson to be more easily lifted off the sea bottom, when deballasted to positive buoyancy, then a non-tapered structure. During the raising and relocation operation, a portion of the core fill is removed, particularly near the inner walls of the annular structure; this action lowers the height of the mound of remaining core fill to provide clearance for the floating caisson as it is towed away from the site, and aids in reducing the skin friction to avoid sudden lift-off. Because only a portion of the core fill needs to be removed, the operation of raising and relocating is significantly faster than it would be if all of the fill had to be removed in order to relocate the caisson.

The core fill is maintained in an unfrozen state by the application and retention of heat. A convenient source of heat can be the exhaust from engines used for powering equipment for drilling or other operations. Alternatively or additionally, heaters can be provided specifically to heat the core fill. The core fill area can be insulated to minimize heat loss through the deck, and through the walls of the caisson into the water. The deck structure and the inner side of the perimetrical wall are convenient carriers for the insulation. Insulation can also be placed on the inner wall of the annular structure if desired, for example if it is desired to maintain the core fill at a different temperature from the temperature of ballast that can be used in the annular structure. Ballast in the annular structure is also maintained in an unfrozen state during offshore operations to enable the caisson to be easily deballasted when relocating.

Referring to FIG. 1, a preferred embodiment of the invention is shown incorporated into an eight-sided caisson 3. The structure is symmetrical, the four major sides 1 alternating with four minor sides 2. The overall shape is that of a square having truncated corners, and is selected to provide a favourable balance of usable deck area with construction cost. The major sides 1 are about two-thirds the length of the sides of a square with the same surface area, and provide a structure having a reasonably limited amount of stresses in the sides and in the corners. Deck 5 is a simply supported box girder system, the deck floor comprising the top flange of horizontal girders 4; deck 5 carries equipment and supplies appropriate to the operation being undertaken. Deflector wall 16, a portion of which is shown in FIG. 1, surrounds deck 5 and projects above it by at least the normal ice thickness, and preferably about four meters. The deflector wall 16 turns back ice that can build up when the laterally fractured ice is pushed upwards on the sloping outer wall, and prevents it from being pushed onto the deck area and possibly damaging equipment. In open-water conditions the deflector wall protects the deck equipment from wave run-up. The angle of deflector wall 16 can be from substantially 10° to substantially 40° to the vertical. As ice cover 11 moves, for example in direction 12, it impacts on sloping sides 1 and 2 and is forced upwards. Lateral cracks 14 form in the ice and it breaks into pieces 15 which move around the caisson 3.

Figure 2:
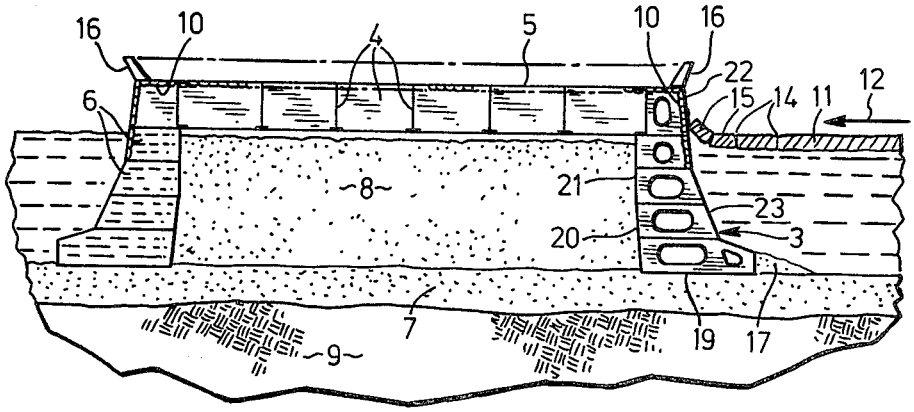
FIG. 2 is a sectional elevation of the embodiment of FIG. 1 at A—A.

FIG. 2 illustrates the manner in which the caisson 3 rests on the sea bottom. If the bottom material has sufficient shear strength and if the depth and level are appropriate, the caisson can be merely sunk into position. More frequently in Arctic operations the bottom comprises unconsolidated clays; in such cases some of the bottom material is removed to expose firm bottom material 9 and easily consolidated berm fill 7 is put into place. Berm fill 7 can be below or extend above the original bottom to provide a level-topped berm which lowers or raises caisson 3 to the appropriate height relative to the surface ice 11. After the caisson is set down on the berm by ballasting, core fill 8 is introduced into the core area. Either the core fill 8 or the berm fill 7, or both, can optionally be compacted or densified using any of several well-known compacting methods. Optionally erosion protection material 17 can be provided to prevent water currents from eroding the berm material 7 from under the caisson base 19. Core fill 8, which is wet when introduced, is kept unfrozen by application of heat and by use of insulation material 10 under the deck 5 and in either interior walls 20 and 21 or exterior walls 22 and 23 or both. Optionally core fill 8 can be dewatered, that is, water can be drained from it, to assist in increasing the bottom friction effect. The unfrozen fill can easily be adjusted in level and a portion of it can be readily removed prior to relocation, whereas frozen fill would require costly and time-consuming chopping operations for removal. Ballast tanks 6 are provided within the caisson for adjustment of buoyancy and trim during relocation of the caisson.

Figure 3:
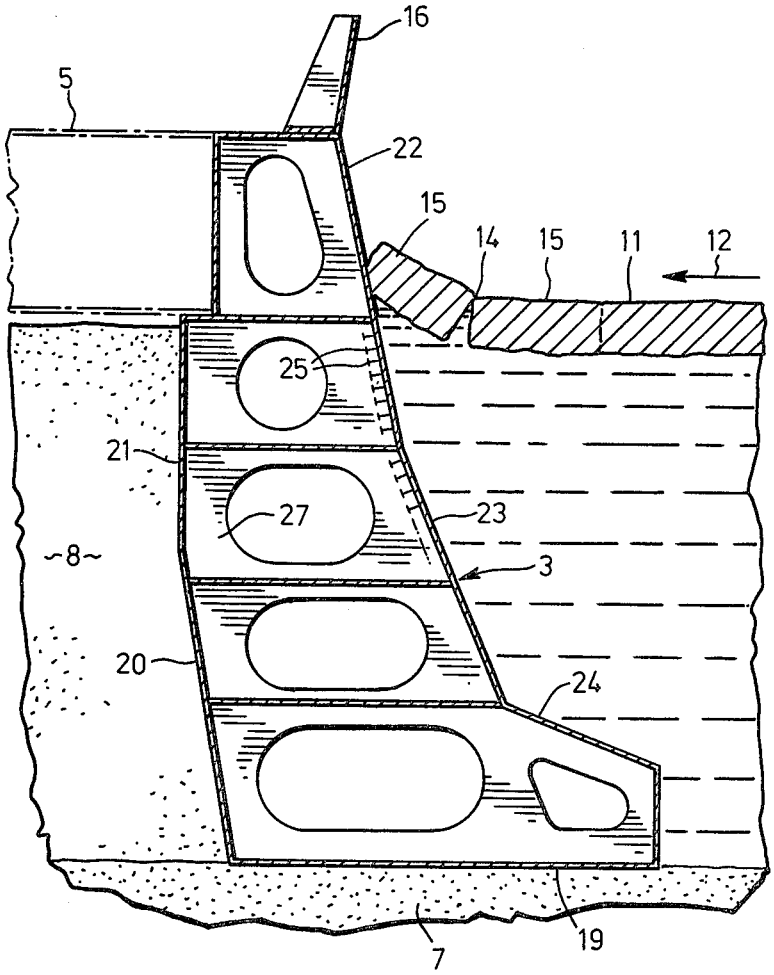
FIG. 3 is an enlargement of part of the section illustrated in FIG. 2.

In FIG. 3 a preferred embodiment of the caisson is illustrated in cross-section. The interior wall comprises vertical wall section 21 and below it, angled wall section 20. The novel angled wall section 20 permits the skin friction of the interior wall to be easily overcome during raising of the caisson, while removing only a small portion of core fill 8. The height and angle of angled wall section 20 have an influence on the operational factors, for example, the ease of densifying the core fill 8, the mode of caisson movement under ice loading and the ease of overcoming skin friction during lift-off. The angled wall section can comprise from substantially one-third the total height of the inner wall to substantially the full height of the inner wall. With a preferred angle of 6°, a preferred height of the angled wall section is substantially two-thirds of the wall height. The angle of outer wall top section 22 is selected to enable upward breaking of ice cover 11 moving towards caisson 3 in direction 12 by inducing lateral cracks 14 and breaking ice into pieces 15. Internal strength members, for example ribs 25, are provided throughout the top 26, base 19, and wall of the caisson 3, and are located and sized to give appropriate strength to the skin of the structure. Interior bulkheads 27 are also provided as appropriate, at least some of them providing sealable cavities for use as ballast or storage chambers. The angles of exterior intermediate wall 23 and exterior lower wall 24 are selected to provide an annular structure of appropriate thickness to withstand ice forces encountered during year-round offshore operations, and to provide buoyancy and trim control during relocation, while minimizing the construction cost.

The features of the invention are operable with any number of sides in the peripheral wall, from three to an infinite number, that is, a circular caisson. Nevertheless, any practical caisson must be designed to withstand horizontal forces produced by the movement of the ice cover across the surface of the water. Although the structure best suited to withstand ice forces is one with an elongated dimension in the direction of ice movement, and a narrow dimension in the transverse direction, the ice in many Arctic areas moves in varying directions; an elongated structure would be subjected to unfavourably directed stresses during periods when the ice movement is not aligned with its longitudinal axis. From a theoretical standpoint, a circular fixed structure causes optimum ice fracturing and hence resistance to ice movement where the ice may move in any direction; however a circular structure is impractical to build as it requires steel plate having two directions of curvature, when used with the sloping sides described above, and it is also relatively impractical to locate equipment on a circular deck. A square structure presents long walls to the ice cover when the ice movement is perpendicular to one of the sides, and the resulting stress in the structural members is severe. At the same time it concentrates stresses in the corners adjacent the side exposed to the ice forces. A substantially regular six-sided structure presents a much shorter straight side to an oncoming ice sheet than a square, and the stress concentration both in the straight sides and in the corners is significantly lower than in a square structure, although if enough (costly) structural material is provided, even a square structure would be sufficiently strong. Consequently, a useful caisson has at least six sides to avoid overly high stress concentrations in the sides and corners of the structure; a six-sided structure can, if desired, withstand by itself the loads imposed by the moving ice without resort to a load-transferring deck. A suitable structure can also be obtained by using the irregular octagon illustrated in FIG. 1, a shape that appears as a square with truncated corners, where the length of the four major sides 1 is preferably about three times the length of the four minor sides 2.

An upper portion 22 of the perimetrical wall near the ice surface has an inward slope. The upper portion extends upwards to a level at least one normal ice thickness above the normal surface of the water. Because of the relatively large mass of the caisson, the angle from the vertical need not be great to withstand the forces on the caisson resulting from movement of the ice cover. An angle of from 5° up is operable, any upper limit being established by costs rather than technical considerations. The horizontal ice loading is reduced relative to that on vertical walls by the ability of the inclined wall to lift the ice as it impacts the wall and thereby to cause fractures lateral to the direction of ice movement. The smaller pieces of ice thus created can pass around the caisson. The caisson can also withstand the forces generated by multi-year ice features. From a level below the upper portion to the bottom of the caisson, the slope of the outer wall is determined by the cost of construction, the required amount of flotation, the height and other technical factors unrelated to the invention. The area of the bottom of the annular structure is great enough to provide frictional resistance to the horizontal ice forces. Combined with the core fill, the friction of the caisson bottom can withstand not only sheet ice but also multi-year pressure ridges.

Deck structure 5 of the platform is supported at or near the top of the annular structure, extending in both directions from one inside wall to the opposite side and covering the central opening of the annulus. The deck structure carries the equipment for drilling or other offshore operations and acts as an insulating member for underdeck heating. The deck can have a large span, whose upper limit is established by the volume of core fill required below the deck and the cost of building the structure, which can comprise a box girder or truss arrangement. The ice loads optionally can be transmitted by thrust bearings into the structure and thence distributed into the opposite side of the caisson. This can reduce the torsional load on the annular structure at the ice-resisting side as the ice impinges at the top, while friction between the base of the structure and the sea bottom provides horizontal resistance to the ice loading. The unitary construction of the caisson with permanent deck enables the equipment to be permanently mounted on the platform and greatly speeds the moving and set-up of the platform in a new location. It is possible to drill year-round and to move the caisson with equipment at any time when the sea is reasonably free of ice cover.

What is claimed is:

1. A floatable caisson capable of being maintained in a fixed position in an ice-covered body of water, comprising:

(a) a perimetrical wall, having an upper portion of sufficient height and disposed at a sufficient angle to the normal surface of said body of water to aid upward fracturing of said ice cover, (b) an inner wall and a bottom defining with said perimetrical wall an annular structure, said inner wall having a lower portion sloping outwardly and downwardly towards said bottom and a substantially vertical upper portion having an upper edge at least as high as said normal water surface, the distance from said bottom to said upper edge defining the height of said inner wall, said annular structure being capable of supporting a deck structure extending across its central opening, and (c) means to maintain in an unfrozen state liquid ballast placed in said annular structure and fill material placed in the volume defined by said inner wall.

2. A caisson as claimed in claim 1, wherein said annular structure has in horizontal cross-section eight sides.

3. A caisson as claimed in claim 2, wherein said annular structure has four major sides alternating individually with four minor sides, each of said major sides being substantially three times each of said minor sides in length.

4. A caisson as claimed in claim 1, wherein said lower portion of said inner wall slopes outwardly and downwardly at an angle from substantially 2° to substantially 10° from a vertical line.

5. A caisson as claimed in claim 1, wherein said lower portion of said inner wall slopes outwardly and downwardly from a point at least one-third said height up from said bottom of said caisson to said upper edge.

6. A caisson as claimed in claim 1, wherein said sloping lower portion of said inner wall comprises substantially all of said inner wall.

7. A caisson as claimed in claim 1, wherein the upper portion of said inner wall is substantially cylindrical.

8. A caisson as claimed in claim 4, wherein said angle is substantially 6°.

9. A caisson as claimed in claim 8, wherein said lower portion of said inner wall slopes outwardly and downwardly from a point substantially two-thirds said height up from said bottom of said caisson to said upper edge.

10. A caisson as claimed in claim 1, wherein said means to maintain said ballast and fill material in an unfrozen state comprises insulation applied to said deck structure.

11. A caisson as claimed in claim 1, wherein said means to maintain said ballast and fill material in an unfrozen state comprises insulation applied to at least a portion of the inside face of said perimetrical wall.

12. A caisson as claimed in claim 1, wherein said means to maintain fill material in an unfrozen state comprises means to provide heat to said fill material.

13. A caisson as claimed in claim 1, wherein said uppermost portion of said perimetrical wall is at an angle at least substantially 5° to the vertical.

14. A caisson as claimed in claim 1, further comprising a plurality of ballast chambers between said inner wall and said perimetrical wall.

15. A caisson as claimed in claim 1, further comprising a deflector wall extending upwardly and outwardly from said uppermost portion of said perimetrical wall.

16. A caisson as claimed in claim 13, wherein said deflector wall extends at an angle from substantially 10° to substantially 40° from a vertical line.

17. A caisson as claimed in claim 13, wherein the height of said deflector wall is at least equal to the normal first-year ice thickness.

18. A caisson as claimed in claim 1, wherein said fill material is dewatered.

19. A caisson as claimed in claim 18, wherein said fill material is densified.

* * * * *